US008166879B2

(12) United States Patent
Jurras, III

(10) Patent No.: US 8,166,879 B2
(45) Date of Patent: May 1, 2012

(54) DETONATOR IGNITION PROTECTION CIRCUIT

(75) Inventor: Mark I. Jurras, III, Canton, CT (US)

(73) Assignee: Dyno Nobel Inc., Salt Lake City, UT (US)

( * ) Notice: Subject to any disclaimer, the term of this patent is extended or adjusted under 35 U.S.C. 154(b) by 681 days.

(21) Appl. No.: 12/045,929

(22) Filed: Mar. 11, 2008

(65) Prior Publication Data

US 2012/0079956 A1 Apr. 5, 2012

Related U.S. Application Data

(60) Provisional application No. 60/894,312, filed on Mar. 12, 2007.

(51) Int. Cl.
*F42B 3/18* (2006.01)
*F42B 3/182* (2006.01)

(52) U.S. Cl. ..... 102/202.5; 102/202.9

(58) Field of Classification Search ..... 102/202.5, 102/202.7, 202.9, 202.11, 202.12, 202.14, 102/275.11; 361/248
See application file for complete search history.

(56) References Cited

U.S. PATENT DOCUMENTS

| | | | | |
|---|---|---|---|---|
| 3,022,446 | A | 2/1962 | Irish, Jr. | |
| 3,948,143 | A * | 4/1976 | Olsen | 89/1.14 |
| 4,495,848 | A * | 1/1985 | Rozner et al. | 89/1.1 |
| 5,587,550 | A * | 12/1996 | Willis et al. | 102/217 |
| 5,616,881 | A * | 4/1997 | Hansen | 102/202.4 |
| 5,631,439 | A * | 5/1997 | Sallee et al. | 102/217 |
| 5,932,832 | A * | 8/1999 | Hansen et al. | 102/202.4 |
| 2004/0083919 | A1 * | 5/2004 | Hosey et al. | 102/202.12 |
| 2011/0002078 | A1 * | 1/2011 | Lansburg et al. | 361/248 |

FOREIGN PATENT DOCUMENTS

| | | |
|---|---|---|
| EP | 0745519 A1 | 12/1996 |
| EP | 0762073 A1 | 3/1997 |
| EP | 0802092 A1 | 10/1997 |
| GB | 1488893 A | 10/1977 |

OTHER PUBLICATIONS

PCT International Search Report; International Application No. PCT/US2008/003242; International Filing date Mar. 11, 2008; Date of Mailing Jul. 21, 2008.

* cited by examiner

*Primary Examiner* — Bret Hayes
(74) *Attorney, Agent, or Firm* — Cantor Colburn LLP

(57) ABSTRACT

An ignition circuit for a detonator is disclosed. The circuit includes an igniter, a transient voltage suppressor (TVS), an energy source and a switch, all electrically connected in series with each other. Current flow through the igniter sufficient to ignite the igniter is prevented until an ignition voltage is applied across the TVS that is equal to or greater than the breakdown voltage of the TVS.

16 Claims, 3 Drawing Sheets

DETONATOR IGNITION PROTECTION CIRCUIT

CROSS REFERENCE TO RELATED APPLICATIONS

This application claims the benefit of U.S. Provisional Application Ser. No. 60/894,312, filed Mar. 12, 2007, which is incorporated herein by reference in its entirety.

BACKGROUND OF THE INVENTION

The present invention relates to electric and electronic detonators and, more specifically, to such detonators having an increased voltage requirement for firing, in order to provide protection against inadvertent firing by stray or induced electrical currents, magnetic fields of electrical conductors, radio signals, lightning strikes or the like.

Electric and electronic delay detonators are known in the art, including detonators which have electronic timing circuits therein. This enables setting electronic time delays between the receipt of an initiation signal and firing of the detonator. Such electric and electronic delay detonators are often provided with a test circuit and, for safety's sake, the energy used for testing is normally set at a level which is insufficient to initiate the igniter. This is usually accomplished by including a ballast resistor in series with the igniter so that the voltage drop across the resistor is great enough to insure that the voltage used to test the igniter is insufficient to activate the igniter. The resistor consumes as waste heat a substantial amount of the energy supplied to the detonator. Such detonators must therefore have an energy supply capable of both satisfying the voltage drop over the resistor and carrying out the testing. When the detonator is to be initiated, sufficient energy must be available both to run the timing circuit and, ultimately, to fire the igniter. This increased energy demand for testing and firing results in smaller shot sizes and a reduction in available delay times. This is because, obviously, larger shot sizes require more energy and longer delay times require the delay circuits to run longer, thereby consuming more energy.

In seismic applications, boreholes are typically primed well in advance of shooting the holes. An unattended primed borehole with a typical seismic blasting detonator may result in initiation of the blast by stray currents or by tampering. Even the energy available from a common flashlight battery connected across the exposed leg wires may initiate the detonator. The art has employed various methods to increase the voltage required to initiate a detonator in order to reduce the sensitivity to stray currents and tampering. However, such prior art methods also increase the energy required to initiate the detonators. Accordingly, there is a need in the art for a detonator ignition protection circuit that overcomes these drawbacks.

BRIEF DESCRIPTION OF THE INVENTION

An embodiment of the invention includes an ignition circuit for a detonator, having an igniter, a transient voltage suppressor (TVS), an energy source and a switch, all electrically connected in series with each other. Current flow through the igniter sufficient to ignite the igniter is prevented until an ignition voltage is applied across the TVS that is equal to or greater than the breakdown voltage of the TVS.

BRIEF DESCRIPTION OF THE DRAWINGS

Referring now to the drawings, which are meant to be exemplary and not limiting, and wherein like elements are numbered alike in the accompanying Figures.

DETAILED DESCRIPTION OF THE INVENTION

An embodiment of the invention, as shown and described by the various figures and accompanying text, provides a detonator ignition protection circuit that provides for a greater firing voltage to fire an electric or electronic igniter without substantially increasing the energy requirements of the igniter. A transient voltage suppressor (TVS), or TVS diode, is placed in series with the igniter, a firing switch and an energy storage device. Alternative to a TVS diode, a metal oxide varistor (MOV) may be employed if size and speed of switching to a conductive state is not a major concern. Both a TVS diode and MOV function in a manner similar to a zener diode. That is, no current will flow through these devices until their respective design threshold voltages are reached or exceeded. Once the threshold or breakdown voltage of such a device is reached or exceeded, the devices exhibit a non-ohmic resistance change and will conduct current. Despite the high breakdown voltage imposed by the TVS in series with the igniter, a substantial increase in energy is not required to fire the electric or electronic igniter due to the non-ohmic resistance change once the breakdown voltage of the TVS is reached or exceeded. In an embodiment, the TVS has a breakdown voltage of 20-volts. In another embodiment, the TVS has a breakdown voltage rating of 200-volts.

Figure 1:
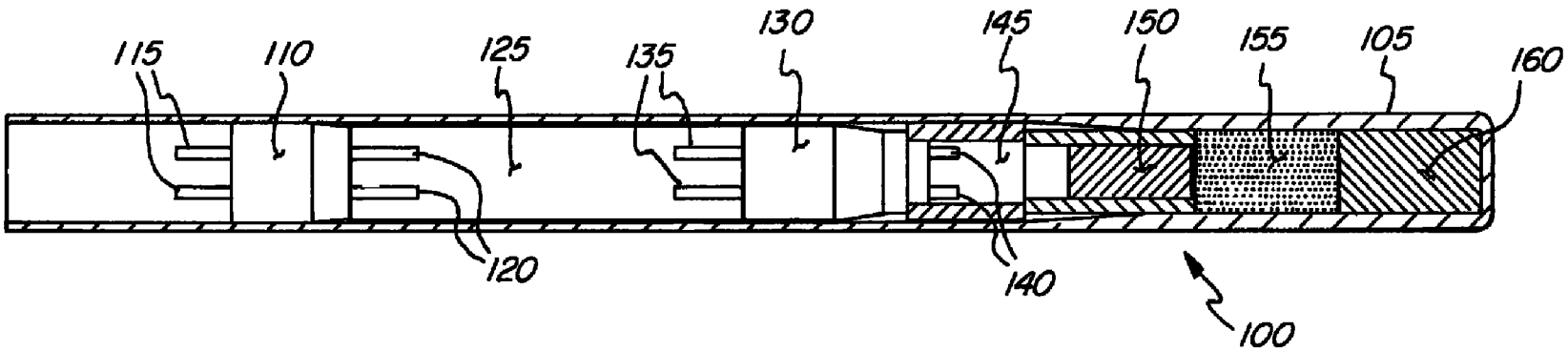
FIG. 1 depicts in cross-sectional schematic view a detonator shell for use in accordance with an embodiment of the invention.

Referring to FIG. 1, an exemplary detonator 100 is depicted in cross-sectional schematic view having a detonator shell 105 that houses an input connector 110 having input pins 115 and output pins 120, a protection circuit 125 (to be discussed in more detail below with reference to FIG. 2), an output connector 130 having input pins 135 and output pins 140, an ignition region 145, a first stage detonator charge 150, a second stage detonator charge 155, and a third stage detonator charge 160. Receipt of a planned ignition voltage at input pins 115 is transferred to protection circuit 125 via output pins 120, which properly passes through protection circuit 125 in a manner to be discussed in more detail below to cause a chain reaction starting with ignition of an igniter 210 (discussed below with reference to FIG. 2) disposed within ignition region 145, which in succession causes firing of the first stage detonator charge 150, the second stage detonator charge 155, and then the third stage detonator charge 160. In an embodiment, the detonator shell 105 is standard commercial detonator shell having a 0.25 inch (6.5 mm) nominal diameter opening, the first stage detonator charge 150 is diazo (diazo dinitro phenol, usually referred to as DDNP), the second stage detonator charge 155 is loose PETN (pentaerythritol tetranitrate, also known as penthrite), and the third stage detonator charge 160 is pressed PETN.

Figure 2:
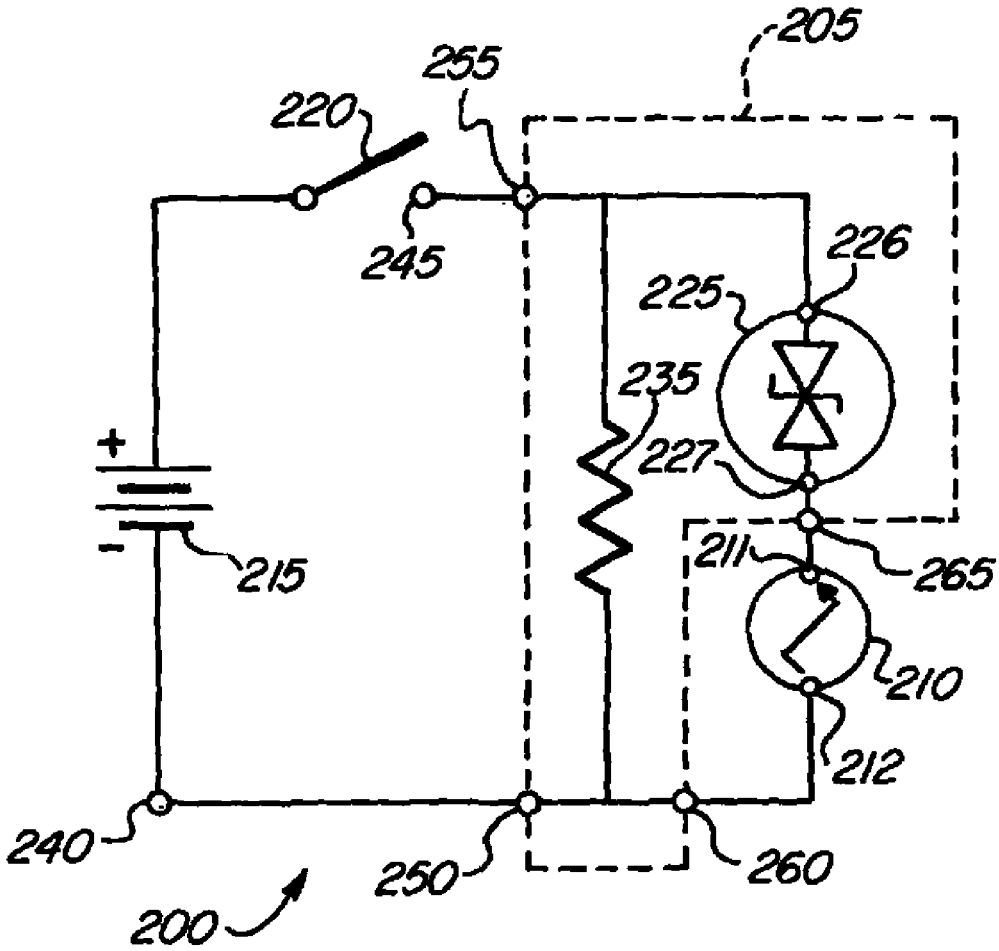
FIG. 2 depicts a schematic of an exemplary firing circuit in accordance with an embodiment of the invention.

Referring now to FIG. 2, an exemplary ignition circuit 200 is depicted having protection circuit 205, an igniter 210 having first 211 and second 212 terminals, a source of electrical energy 215, and a switch 220. In an embodiment, protection circuit 205 includes a TVS 225 having first 226 and second 227 terminals, and an optional resistor 235. As illustrated, TVS 225 is electrically connected in series with igniter 210 at first terminal 211, and energy source 215 is electrically connected in series with igniter 210 at the opposing second terminal 212. As also illustrated, energy source 215 and switch 220 are electrically connected in series with each other, and electrically connected across first terminal 226 of TVS 225 and second terminal 212 of igniter 210, which places all components of ignition circuit 200 in series with each other in the absence of optional resistor 235.

In relating FIG. 2 to FIG. 1, contact points 240, 245 in FIG. 2 are electrically synonymous with input pins 115 in FIG. 1, contact points 250, 255 in FIG. 2 are electrically synonymous with output pins 120 in FIG. 1, contact points 260, 265 in FIG. 2 are electrically synonymous with input pins 135 in FIG. 1, and terminals 211, 212 in FIG. 2 are electrically synonymous with output pins 140 in FIG. 1. While not specifically depicted in FIG. 1, it will be appreciated by the description and illustration disclosed herein that the energy source 215 and switch 220 illustrated in FIG. 2 are connected to pins 115 of detonator 100 in FIG. 1 (synonymous with contact points 240, 245 of FIG. 2), thereby providing the necessary energy, switching means and ignition voltage to fire igniter 210 disposed in ignition region 145. In an embodiment, energy source 215 is a battery, a charged capacitor, or any other energy source suitable for the purposes disclosed herein, and switch 220 is an electronic switching device, or any other switching device suitable for the purposes disclosed herein, where switch 220 is a separate component or integrated within a time delay module.

As mentioned above, resistor 235 may be optionally disposed in electrical connection across first terminal 226 of TVS 225 and second terminal 212 of igniter 210, and in parallel with the series-connected energy source 215 and switch 220. When present, resistor 235 provides an electrical path in front of TVS 225 and igniter 210 for pre-testing the integrity of electrical connections from the firing station (not illustrated) up to the protection circuit 205 and igniter 210, and for protecting the circuit 205 against stray static voltages.

In accordance with an embodiment of the invention, current flow through igniter 210 sufficient to ignite igniter 210 is prevented until an ignition voltage is applied across the terminals 250, 255 of protection circuit 205 that is equal to or greater than the breakdown voltage of TVS 225.

Figure 3:
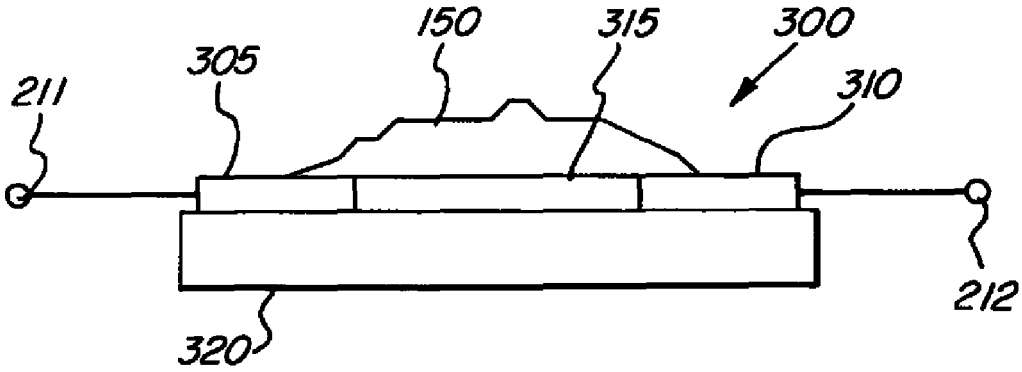
FIG. 3 depicts an alternate igniter to that depicted in FIG. 2 for use in accordance with an embodiment of the invention.

In an embodiment, igniter 210 is a bridgewire designed for contact with (for example, to be embedded within) an explosive device (for example, the first stage detonator charge 150) with a pair of lead wires extending from the bridgewire. However, it will be appreciated that other igniters suitable for the purposes disclosed herein may be employed in place of the bridgewire, such as a semiconductor bridge 300 for example, generally depicted in FIG. 3, having lands 305, 310 in electrical contact with a semiconductor layer 315, all disposed on a substrate 320, with the first stage detonator charge 150 being disposed across lands 305, 310 and semiconductor layer 315. Operation of such a semiconductor bridge 300 in the field of explosive detonators is well known in the art and is not discussed further herein.

In an embodiment, TVS 225 and optional resistor 235 are surface mounted on a circuit board, generally depicted by reference numeral 205 and the associated dashed-line graphical box depicted in FIG. 2. The combination of circuit board 205 with surface-mounted TVS 225 and resistor 235 (collectively referred to as surface-mounted components) is so dimensioned as to be insertable through the space defined by the opening of detonator shell 105, which in an embodiment is a standard commercial detonator shell having a 0.25 inch (6.5 mm) nominal diameter opening. When the circuit board with surface-mounted components is positioned within the detonator shell, the dielectric breakdown voltage between any of the surface-mounted components and the interior wall of the detonator shell is greater than the breakdown voltage of TVS 225, and preferably the through-air dielectric breakdown voltage between any of the surface-mounted components and the interior wall of the detonator shell is greater than the breakdown voltage of TVS 225. In an embodiment, the through-air dielectric breakdown voltage is greater than 500 volts, which results in an unobstructed through-air distance of about 0.017 inches (0.43 mm) at a through-air breakdown voltage of 30,000 volts/inch (1,181 volts/mm).

Upon closure of the switch 220 (planned ignition), not only does the energy source 215 have sufficient energy to generate a voltage at terminals 250, 255 in excess of the breakdown voltage of TVS 225 to generate sufficient current flow to ignite the igniter 210, but also the energy source 215 further has sufficient energy to permanently damage TVS 225. Since the detonator 100 is an intended self-destructive device, there is no need for TVS 225 to be designed for passing a non-leakage current without damage thereto. As such, a TVS 225 having a conductive current rating far below the actual current passed are fully sufficient for the purposes disclosed herein, thereby permitting a small TVS to be used in a compact design for the protection circuit 205.

In an embodiment and in the event of the switch 220 being closed, the energy source 215 has sufficient energy to generate an ignition voltage to ignite the igniter 210 that is equal to or greater than 1.1 times the breakdown voltage of TVS 225. And, in the event of the switch 220 being open, TVS 225 has a breakdown voltage sufficient to prevent the igniter 210 from firing upon the occurrence of a stray voltage at terminals 250, 255 less than the breakdown voltage of TVS 225.

It is contemplated that in an embodiment where TVS 225 has a breakdown voltage of 200 Volts, sufficient protection of igniter 210 will be provided against a standard 120 VAC-rms voltage at input pins 115 having a peak voltage of about 170 Volts. By employing a TVS having a 200 Volt breakdown voltage and a very small current rating, a relatively large energy pulse from a sufficiently charged capacitor discharge firing system will result in a one-time use of TVS 225, which will fail in conduction mode. Since TVS 225 needs to work only once, such an occurrence of failure in the conduction mode is perfectly acceptable for the purposes disclosed herein.

While embodiments of the invention have been described herein employing a circuit board 205 with TVS 225 and resistor 235 surface-mounted thereon, it will be appreciated that other packaging arrangements can be employed for the purposes disclosed herein, such as integrally molding TVS 225 and resistor 235 into a plug, again generally depicted by reference numeral 205 and the associated dashed-line graphical box depicted in FIG. 2, where the plug 205 with the integrally-molded TVS 225 and resistor 235 is so dimensioned as to be insertable through the space defined by the opening of a standard size 0.25 inch (6.5 mm) diameter detonator shell 105.

Devices other than the TVS 225 device may act in a similar fashion as the aforementioned TVS device, where after the breakdown voltage is reached the voltage across the device drops to very close to zero voltage, thereby allowing full firing power to pass through circuit 205 to igniter 210. For example, an MOV device may be substituted for the TVS 225 in circuit 205, with the other components remaining the same.

However, TVS devices are preferred over an MOV because the leakage currents from a TVS are generally an order of magnitude lower than those from an MOV. And, as discussed above, the TVS device or the MOV may be readily molded inline with the lead-in wire or internal plug of the detonator.

The accuracy of the timing of initiation of individual explosive charges in a multiple-charge blasting system must be closely controlled to achieve the desired fragmentation of ore and rock, and to reduce the influence of the blast on structures outside the blast zone. The accuracy of timing of the initiation of individual charges controls the effectiveness of the blast by providing the required distribution of blast induced shockwaves. Embodiments of the invention provide detonators that can be used for closely controlling the timing of the initiation of individual explosive charges in multiple-explosive charge blast operations. For example, for electronic delay of detonator 100, the test voltage provided to contact points 250, 255 of ignition circuit 200 could be safely raised to a level just below the breakdown voltage of TVS 225 without concern of prematurely firing the very low energy igniter 210, thereby enabling better communication with other connected detonators within the multiple-charge blasting system. Additionally, and contrary to other blasting systems that employ a series-connected resistor to protect the igniter, which inherently results in an $I^2R$ power loss across the series-connected resistor during ignition, embodiments of the invention do not have such a power loss and therefore have more energy available from energy source 215 for use by electronic delay circuitry, communications, and controls of the blasting system.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An ignition circuit for a detonator, comprising:

an igniter, a transient voltage suppressor (TVS), an energy source and a switch, all electrically connected in series with each other;

wherein current flow through the igniter sufficient to ignite the igniter is prevented until an ignition voltage is applied across the TVS that is equal to or greater than the breakdown voltage of the TVS; and wherein the igniter and the TVS conduct a same induced current when present, the current having a driving voltage sufficient to overcome the breakdown voltage of the TVS, for all voltage conditions across the TVS that produces a current flow through the TVS;

wherein the breakdown voltage across the TVS in a first direction is the same as the breakdown voltage across the TVS in the opposite direction.

2. The ignition circuit of claim 1, wherein the TVS is disposed directly between the igniter and the switch.

3. The ignition circuit of claim 1, wherein the igniter comprises a bridgewire.

4. The ignition circuit of claim 1, wherein the igniter comprises a semiconductor bridge.

5. The ignition circuit of claim 1, further comprising a resistor electrically connected in parallel across the series-connected energy source and switch, and electrically connected in parallel across the series-connected TVS and igniter.

6. The ignition circuit of claim 1, further comprising:

a resistor electrically connected in parallel across the series-connected energy source and switch, and electrically connected in parallel across the series-connected TVS and igniter.

7. The ignition circuit of claim 1, further comprising:

a circuit board having the TVS surface mounted thereon;

wherein the circuit board with the surface-mounted TVS is so dimensioned as to be insertable through a space defined by an opening of a standard size one-quarter inch diameter detonator shell.

8. The ignition circuit of claim 7, wherein an unobstructed through-air dielectric breakdown voltage between the surface-mounted TVS and an interior wall of the detonator shell is greater than the breakdown voltage of the TVS.

9. The ignition circuit of claim 8, further comprising:

a resistor electrically connected in parallel across the series-connected energy source and switch, and electrically connected in parallel across the series-connected TVS and igniter;

wherein the resistor is surface mounted on the circuit board.

10. The ignition circuit of claim 1, wherein upon closure of the switch the energy source has sufficient energy to generate a voltage across the terminals of the TVS in excess of the breakdown voltage of the TVS, and to generate sufficient current flow to ignite the igniter.

11. The ignition circuit of claim 10, wherein upon closure of the switch the energy source further has sufficient energy to permanently damage the TVS.

12. The ignition circuit of claim 10, where in the event of the switch being closed the energy source further has sufficient energy to generate an ignition voltage to ignite the igniter that is equal to or greater than 1.1 times the breakdown voltage of the TVS.

13. The ignition circuit of claim 12, where in the event of the switch being open the breakdown voltage of the TVS is sufficient to prevent the igniter from firing upon the occurrence of a stray voltage across the terminals of the TVS equal to or less than the breakdown voltage of the TVS.

14. The ignition circuit of claim 1, further comprising:

a plug having the TVS integrally molded therein;

wherein the plug with the integrally-molded TVS is so dimensioned as to be insertable through a space defined by an opening of a standard size one-quarter inch diameter detonator shell.

15. The ignition circuit of claim 1, wherein the TVS has a breakdown voltage of 200 volts.

16. An ignition circuit for a detonator, comprising:

an igniter, a transient voltage suppressor (TVS), an energy source and a switch, all electrically connected in series with each other;

wherein current flow through the igniter sufficient to ignite the igniter is prevented until an ignition voltage is applied across the TVS that is equal to or greater than the breakdown voltage of the TVS;

wherein the igniter, the TVS, the energy source and the switch, all conduct a same induced current when present and having a driving voltage sufficient to overcome the breakdown voltage of the TVS, for all voltage conditions across the TVS that produces a current flow through the TVS;

wherein the breakdown voltage across the TVS in a first direction is the same as the breakdown voltage across the TVS in the opposite direction.

* * * * *